US005408940A

United States Patent [19]

Winchell

[11] Patent Number: 5,408,940

[45] Date of Patent: Apr. 25, 1995

[54] ADJUSTABLE HEIGHT WORK SURFACE WTIH RACK AND PINION ARRANGEMENTS

[76] Inventor: Paul W. Winchell, 114 Academy Rd., North Andover, Mass. 01834

[21] Appl. No.: 904,224

[22] Filed: Jun. 25, 1992

[51] Int. Cl.[6] ..... A47B 9/06

[52] U.S. Cl. ..... 108/147; 108/10

[58] Field of Search ..... 108/5, 20, 21, 33, 10, 108/92, 96, 106, 108, 143, 144, 146, 147; 312/208.1, 223.1, 223.2, 223.3, 351; 211/175, 207, 208, 209; 248/188.2, 188.4, 188.5, 188.3

[56] References Cited

U.S. PATENT DOCUMENTS

| | | | |
|---|---|---|---|
| 1,915,802 | 6/1933 | Roshnell | 108/10 |
| 1,927,598 | 9/1933 | Schlichter | 254/7 |
| 3,140,559 | 7/1964 | Grow et al. | 108/10 X |
| 3,851,854 | 12/1974 | Roybai | 254/7 C |
| 4,294,332 | 10/1981 | Ready | 182/141 |
| 4,498,556 | 2/1985 | Garton | 182/19 |
| 4,590,865 | 5/1986 | Rütsche et al. | 108/147 X |
| 4,600,085 | 7/1986 | Gagnon | 187/24 |
| 4,752,102 | 6/1988 | Rasmussen | 108/147 X |
| 4,944,366 | 7/1990 | Pryor et al. | 182/141 |
| 4,967,733 | 11/1990 | Rousseau | 182/13 |
| 4,981,085 | 1/1991 | Watt | 108/147 |

FOREIGN PATENT DOCUMENTS

| | | | |
|---|---|---|---|
| 9043798 | 2/1990 | Australia | 108/147 |
| 3027374 | 2/1982 | Germany | 108/147 |
| 3314388 | 5/1984 | Germany | 108/147 |

*Primary Examiner*—Clifford D. Crowder
*Assistant Examiner*—Ismael Izaguirre
*Attorney, Agent, or Firm*—Pearson & Pearson

[57] ABSTRACT

Apparatus providing an adjustable height work surface. A work table is cantilevered from posts supported for vertical motion inside columns from a base. A drive connected between the work table and the base changes the height of the work table and is located between the columns and posts. Each post carries a rack that engages with a pinion supported by a column for rotation about a common axis. A rigid shaft interconnects two pinions and prevents relative pinion rotation. A stabilizing structure in each column interacts with the post to maintain engagement between the rack and pinion structure and maintains the work table in a horizontal position during adjustment and use.

4 Claims, 3 Drawing Sheets

ADJUSTABLE HEIGHT WORK SURFACE WTIH RACK AND PINION ARRANGEMENTS

BACKGROUND OF THE INVENTION

1. Field of the Invention

This invention generally relates to furniture such as work tables with work surfaces and more specifically to methods and apparatus for adjusting the height of such work surfaces.

2. Description of Related Art

Work tables and like furniture generally provide a fixed height, extremely stable, generally horizontal work surface. In many embodiments such work tables are formed with a horizontal deck assembly or work table supported by upright supports at each of the four corners. More recently, such work tables have been constructed with a pedestal base that supports the table at a rear portion to cantilever the deck assembly forward from the base. This construction eliminates the front upright supports and provides clear knee room at the front, or working area, of the worktable.

Generally corner-supported and cantilevered fixed work tables are supported from below the work surfaces. The plane of the work surface and extensions thereof do not intersect any portion of the work table or its supporting structure. Therefore the work table does not, by itself, limit the size of any item that it supports.

Fixed height work tables are characterized by a fixed working surface height normally set for an average individual in either a sitting or standing posture. Consequently, the work table height is not optimized or ergonomically correct for any specific individual who may be using the work table. In one posture, for example a sitting posture, the work table height will not be optimized for that person in any other posture. If an individual stands, he or she will be forced to stoop. Further, even if the work table height is optimized for one individual in one posture, it probably is not ergonomically correct for other individuals working at the same table even with the same posture. To overcome these problems it has been proposed to provide work tables and other apparatus with adjustable height work surfaces.

The following patents disclose apparatus in which all the structure for adjusting the work surface height lies below the work table or work surface.

| | | |
|---|---|---|
| 1,927,598 | (1933) | Schlichter |
| 3,851,854 | (1974) | Roybal |
| 4,944,366 | (1990) | Pryor et al |

U.S. Pat. No. 1,927,598 (Schlichter) discloses a portable elevating table that comprises a stationary lower plate, a stationary middle plate and a vertically adjustable upper plate. Upright supports in the form of columns at each corner of the table extend between the lower and middle plates and contain means for vertically adjusting the upper plate with respect to the middle plate. A vertical screw within each column attaches to the upper plate and extends to engage a threaded spiral gear located at the top of a corresponding column. A manual operating mechanism rotates a first shaft and connected spiral gear nuts. A gear and chain mechanism interconnects the first shaft with a parallel second shaft with spiral gear nuts. As the operating mechanism rotates, all the spiral gear nuts operate together thereby moving the upper place vertically relative to the middle and lower plates.

U.S. Pat. No. 3,851,854 (Roybal) discloses a scaffold having a stationary frame for supporting vertically movable intermediate and upper frames. The intermediate frame carries vertically positioned, rotatable sleeves at each corner that extend above and below the plane of the intermediate frame. A lower threaded portion of each sleeve screws into a leg that extends vertically from the stationary frame. Each upper sleeve portion has an opposite thread to engage a correspondingly threaded leg that depends from each corner of the upper frame. A common motor drive rotates the sleeves in synchronism to adjust the vertical position of the intermediate frame with respect to the stationary frame and, simultaneously, the vertical position of the upper frame with respect to the intermediate frame.

U.S. Pat. No. 4,944,366 discloses a scaffolding with a rectangular lower frame. Vertically positioned, pneumatically operated cylinders at each corner carry and vertically position an upper work support frame.

Each of the foregoing patents discloses an apparatus for providing an unobstructed adjustable height work surface with all the operating mechanism below the work surface. However, none of these structures is particularly adapted for providing furniture with adjustable height work surfaces. Each requires a support at each corner to provide stability and to provide even movement while the work surface remains horizontal. Thus, this apparatus is not adapted to cantilevered structures. The mechanisms and supports can become bulky and interfere with clearance under the table Moreover these mechanisms are difficult to implement given problems in synchronizing the relative motions at each corner and can become expensive.

The following patents disclose other apparatus that provides work surface adjustment:

| | | |
|---|---|---|
| 4,294,332 | (1981) | Ready |
| 4,498,556 | (1985) | Garton |
| 4,600,085 | (1986) | Gagnon et al |
| 4,967,733 | (1990) | Rousseau |

U.S. Pat. No. 4,294,332 (Ready) discloses a scaffold comprising a pair of parallel towers. Each tower comprises spaced, vertical rails for supporting vertical gear racks. A self-elevating carriage mounts between the rails. The carriage has a motorized rotatable shaft with two pinion gears for engaging the respective gear racks on the vertical rails thereby to move the carriage vertically on the tower.

U.S. Pat. No. 4,498,556 (Garton) discloses a vertically adjustable platform. The apparatus includes a multi-section, centrally disposed mast with a rack gear. A motor driven pinion engages the rack thereby to adjust the vertical position of the platform with respect to the mast.

U.S. Pat. No. 4,600,085 (Gagnon et al) discloses a platform lift mechanism having four upright telescoping segments. The lowermost first segment is secured to the floor. The uppermost fourth segment is secured to the base of the platform to be lifted. A linear drive comprising an elongated screw and rotatable nut assembly moves the segments relative to each other to position the platform vertically.

U.S. Pat. No. 4,967,733 (Rousseau) discloses a scaffold-like lifting carriage comprising four corner posts, each having a gear rack, and a rectangular platform mounted between the corner posts. The platform has a shaft on each side, each shaft connecting two gear pinions that engage the corner post racks. A motor on the platform rotates the shafts by means of a power chain. As the shafts rotate, the pinion gears advance over the corresponding racks thereby adjusting the vertical position of the platform.

Although each of the foregoing patents discloses apparatus for adjusting the height of a horizontal work surface, each requires portions of the apparatus to extend above the work surface. Moreover, the Schlichter, Roybal, Pryor et al, Gagnon and Rousseau patents disclose structures that support the platform at four different positions. The apparatus in the Ready and Garton patents disclose a cantilever-like work surface, but the support structure extends above the work surface. Moreover, the mechanisms in all of these patents are not constrained by the applications to sizes that can be readily adapted to furniture applications. The Schlichter, Ready, Garton and Rousseau disclose mechanisms in which a motor drive rotates a pinion along a rack to adjust the height. Consequently the rack and pinion must be sized to support the full weight of any load applied to the work surface. For furniture design loads a similar structure will become bulky and unpleasant looking, even with shrouds for covering the mechanisms.

SUMMARY

Therefore it is an object of this invention to provide a method and apparatus for adjusting the position of a work surface.

Another object of this invention is to provide a method and apparatus for providing a stable, adjustable work surface.

Another object of this invention is to provide a stable, cantilevered work surface.

Yet still another object of this invention is to provide an adjustable work surface that is not obstructed by any of the mechanisms for adjusting the position of the work surface.

Yet still another object of this invention is to provide a stable, cantilevered, adjustable height surface that is unobstructed by any mechanism associated with the apparatus.

In accordance with this invention apparatus for providing an adjustable work surface includes a base having a plurality of first supports and a planar work surface structure. A plurality of second supports from the planar work surface structure align with the first supports to enable motion between the work surface and the base. A drive affixed to the base and work surface adjusts the spacing therebetween. Motion converters at each of the aligned first and second supports converts motion between the first and second supports in one form into a second motion form. A link interconnects each of the motion converters to prevent unequal increments of the second motion in response to the first motions.

In accordance with another aspect of this invention, an article of furniture having a variable height work surface includes a base with a pair of spaced vertical first supports. A horizontal work table has a pair of spaced depending second supports that align with corresponding ones of the first supports. A drive interconnects the base and the work table for adjusting the vertical position of the work table with respect to the base and thereby produces relative linear motion between each aligned first and second supports. A pair of rack and pinion mechanisms convert the relative linear motion into angular motion. The pinions rotate about a common axis. A rigid linking structure is affixed to each of the pinions and lies along the common axis. This structure prevents relative motion of the pinions.

In accordance with still another aspect of this invention, the height of a work table with respect to a supporting surface is adjusted by applying a displacement force between a base and a planar work surface at a position intermediate first and second supports. This height adjustment produces relative linear motion between the first and second supports that is converted to angular motion. The angular motion is then synchronized at each of the aligned first and second supports for preventing unequal angular displacement.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
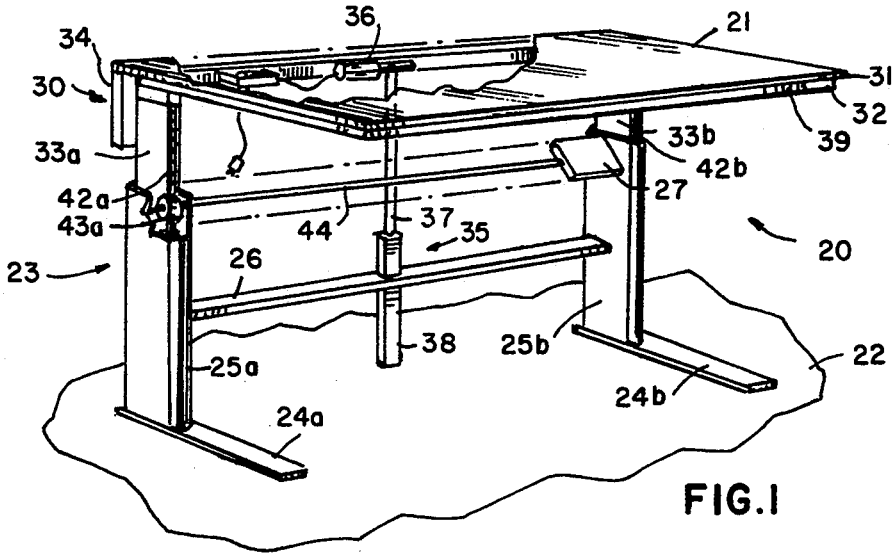
FIG. 1 is a perspective view of an article of furniture that incorporates an adjustable height work surface in accordance with this invention.

FIG. 1 discloses an article of furniture constructed in accordance with this invention and configured as a work table 20 that provides a horizontal work surface 21. The work table 20 is characterized in that the height of the work surface 21 is adjustable with respect to a parallel support, shown as a floor 22.

The work table 20 includes, as a first major assembly, a pedestal or base 23 with horizontal legs **24*a* that rest on the floor 22. Left and right columns 25*a* and 25*b* extend vertically from the horizontal legs 24*a* and 24*b*. As shown in FIG. 1, each of the columns 25*a* and 25*b* attaches to its respective horizonal leg 24*a* and 24*b* at a back or rear portion. Each of the columns 25*a* and 25*b* is open at the top. The columns 25*a* and 25*b* collectively constitute spaced first supports that mount on the support surface or floor 22. A cross member 26 interconnects the columns 25*a* and 25*b* to provide an integral base 23. A shroud 27, partially broken away in FIG. 1**, covers a certain portions of the operating mechanism.

A deck assembly or work table unit 30 constitutes a second major assembly of the work table 20. The work table unit includes a planar horizontal table top 31 and a supporting open frame 32 below the table top 31. A left post **33*a* and right post 33*b* depend vertically from the frame 32. Each of the posts 33*a* and 33*b* is aligned with a corresponding one of the columns 25*a* and 25*b*. Each of the posts 33*a* and 33*b* constitutes a second support that is aligned with a corresponding column. In this specific embodiment, the posts 33a and 33b telescope or nest in the columns 25a and 25b respectively. The deck assembly 30 includes an optional back frame 34. The back frame 34** can serve as a support for ancillary items, such as shelving, when desired for a particular application.

Still referring to FIG. 1, a linear drive unit 35 constitutes a third major assembly and provides the displacement function. The unit 35 is located intermediate the columns 25a and 25b and normally will be centered on the work table 31 at the back edge thereof. As particularly depicted in FIG. 1, the linear drive unit 35 includes a reversible, right angle drive electric motor 36 for rotating a vertically disposed threaded shaft 37. A receptacle 38 connects to the cross member 26 so that rotation of the shaft 37 causes the shaft to move vertically with respect to the receptacle 38 and thereby produce vertical motion of the work table unit 30 relative to the base 23. A switching assembly 39 controls the operation of the motor 36. The wiring of this electrical motor is not specifically disclosed as such drive motors and controls and electrically operated linear drive units are well known in the art. Moreover, the drive unit can comprise alternates to an electric reversible motor and related components, such as manually operated cranks or pneumatically-driven units.

Figure 2:
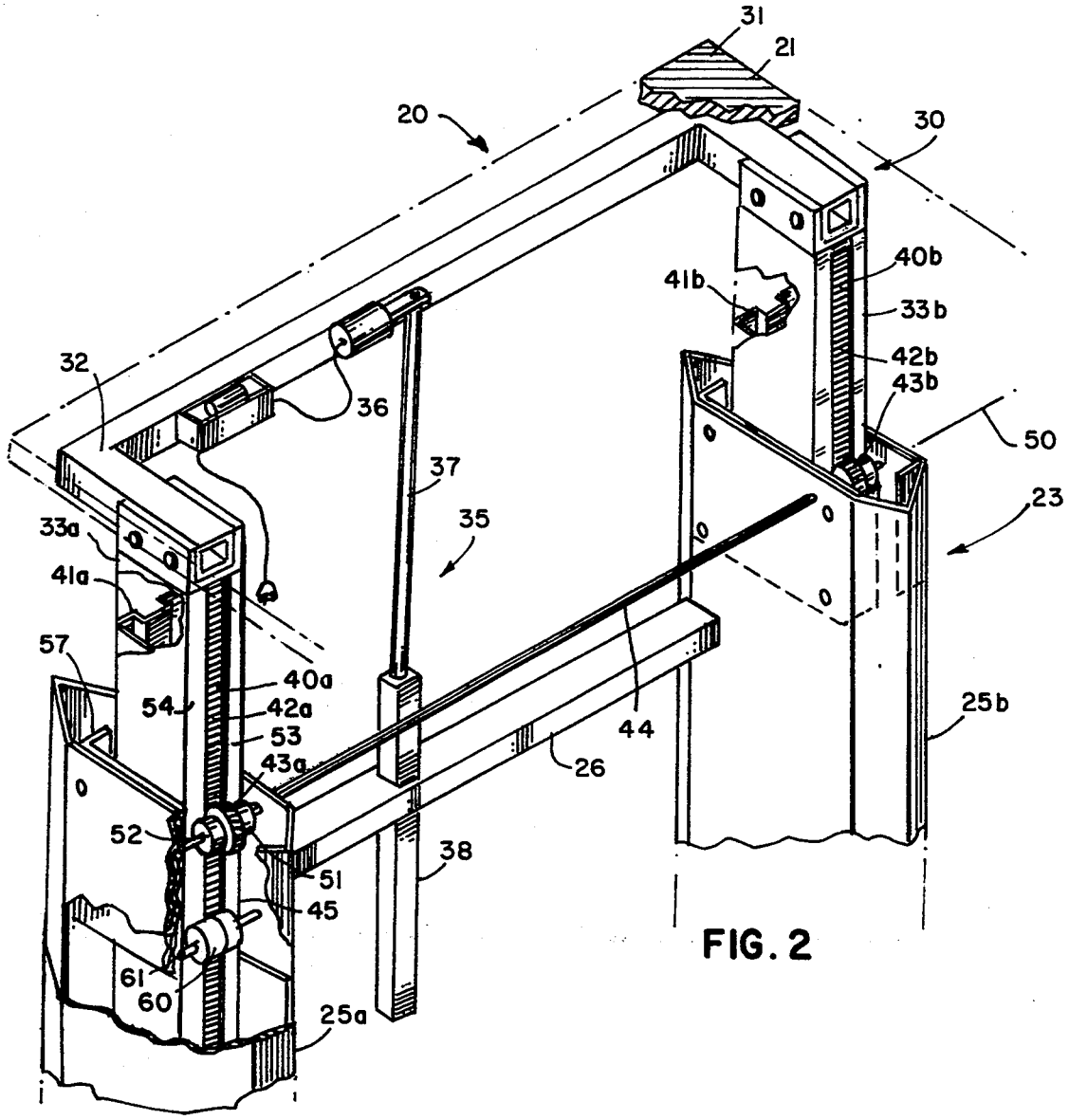
FIG. 2 is a perspective view of portions of the article of furniture in FIG. 1 that depicts details of this invention.

As shown generally in FIG. 1 and in slightly more detail in FIG. 2, the work table 20 includes a mechanism for maintaining the work surface 21 in a horizontal plane during height adjustment and during use. Each of the posts 33a and 33b has vertically oriented forward channels 40a and 40b and vertically oriented rear channels 41a and 41b. The front channels 40a and 40b carry racks 42a and 42b fixed to the posts 33a and 33b respectively.

As the posts 33a and 33b move vertically, the racks 42a and 42b engage pinions 43a and 43b on the columns 25a and 25b respectively. Each rack and pinion assembly, such as rack 42a and pinion 43a, converts linear motion between a post and column, such as the post 33a and column 25a, as a first motion into angular motion, as a second motion.

A rigid link in the form of a rigid shaft shaft structure 44 is affixed to both the pinions 43a and 43b. Consequently, within the elastic limits of the shaft structure 44, it is not possible to rotate the pinions 43a and 43b relative to each other. The spaced rack and pinion structures therefore prevent the posts 33a and 33b from displacing unequal amounts. The post 33a and 33b must advance in synchronism. This assures that the work surface 21 remains horizontal during height adjustment.

If an off-center load is placed at the right edge of the work surface 21, as shown in FIG. 1, the load produces a clockwise moment about a fulcrum at the drive unit 35. The natural tendency is to lower the post 33a and raise the post 33b. However, lowering the post 33b requires clockwise motion of the pinion 43b when viewed from the left in FIGS. 1 and 2, while raising the post 33a requires clockwise rotation of the pinion 43b. However, the shaft structure 44 prevents this relative displacement of the pinions 43a and 43b. Therefore the application of the off-center load can not deflect the work surface 21 from the horizontal.

As will now be apparent, the work table 20 as depicted in FIGS. 1 and 2 provides an adjustable height work surface 21. This work surface 21 is stable during adjustment and during use, even though the work surface 21 is cantilevered from the post 33a and columns 25a to provide clear knee room below the work surface 21. The operating mechanisms do not obstruct the work surface 21 and do not impinge in the knee room area.

In accordance with another aspect of this invention, the drive mechanism 35 produces all the lift and generally carries all the load. In prior rack and pinion assembly driver, a pinion drives the rack to displace the load and must be sized accordingly. In accordance with this invention the pinions are merely followers. Loading on the pinions and interconnecting shaft occurs only if there is some imbalance in the forces that tends to produce relative displacement of the pinions 43a and 43b. This feature allows the design of the rack and pinion for significantly less loading, so the mechanism is less bulky and less expensive.

Figure 3:
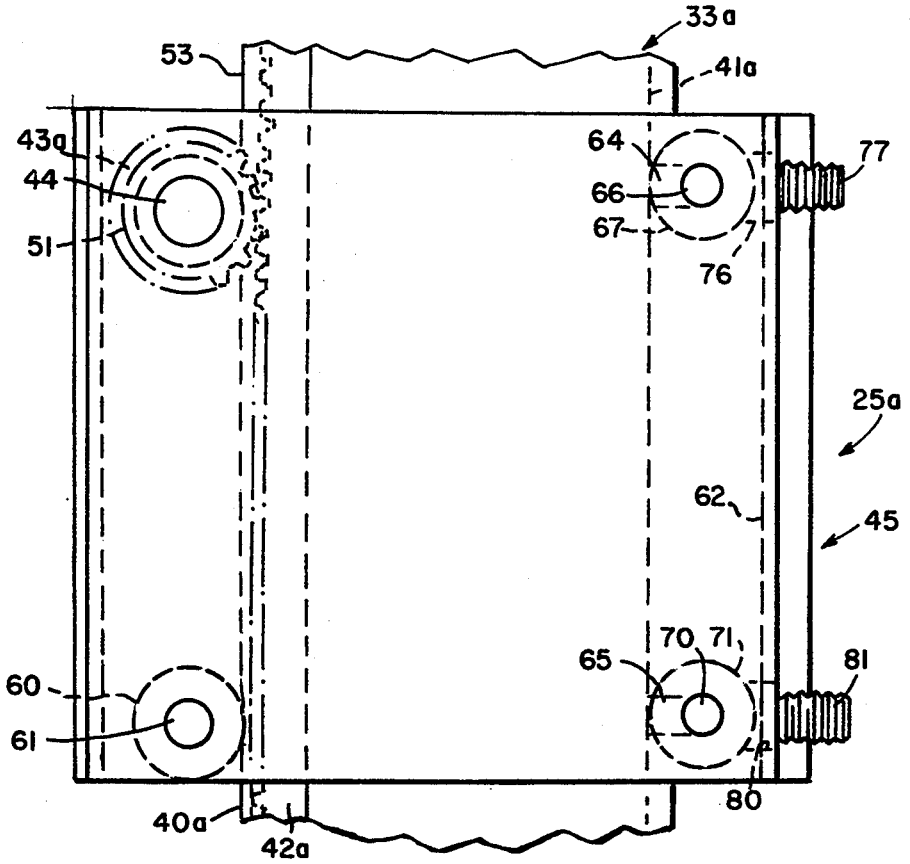
FIG. 3 is a side view that depicts a portion of the article of furniture shown in FIG. 1.
Figure 4:
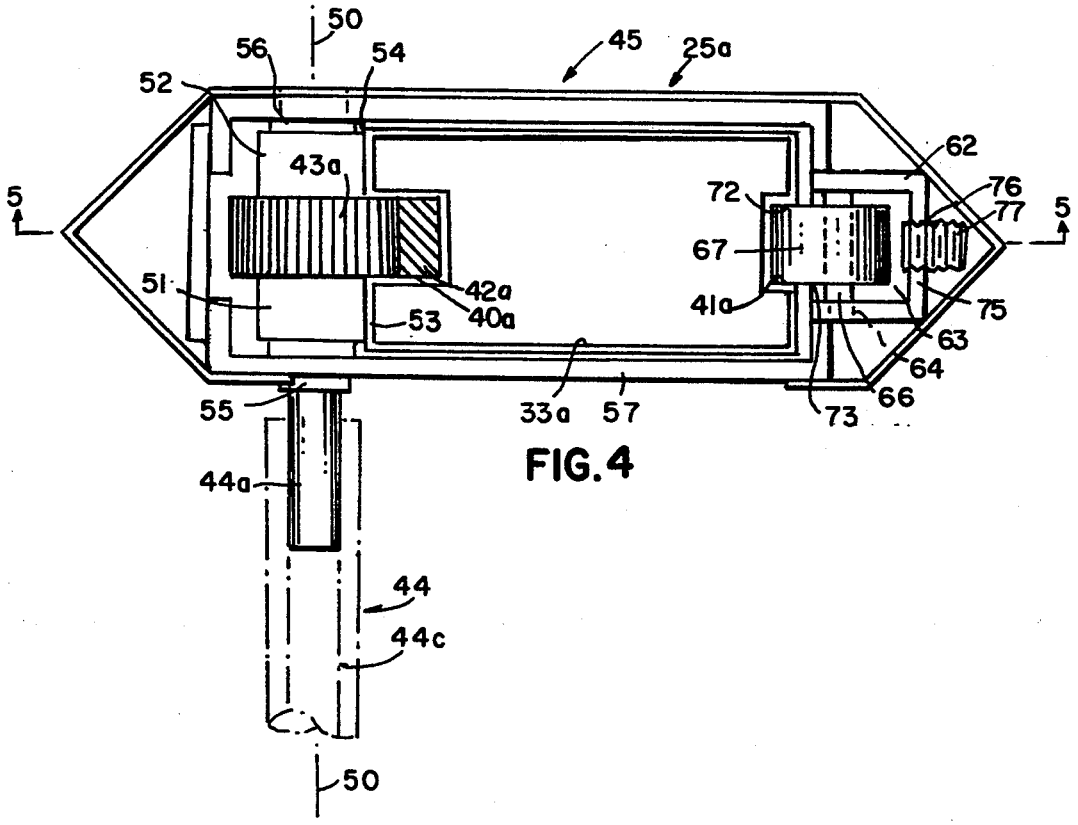
FIG. 4 is a top view of the portion of the article of furniture shown in FIG. 3.
Figure 5:
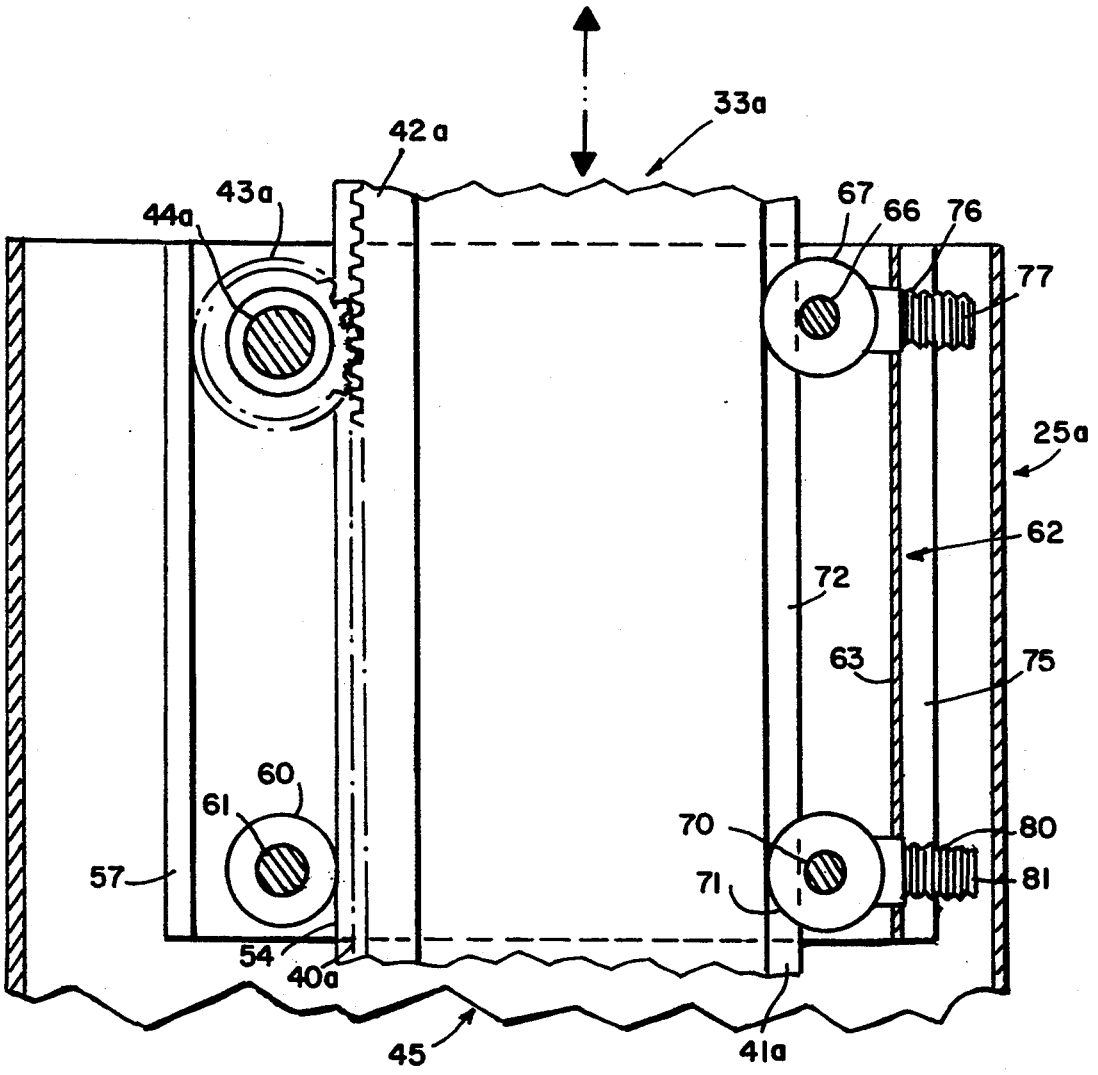
FIG. 5 is a section taken along lines 5—5 in FIG. 4.

FIGS. 3 through 5 depict one embodiment of a relatively simple and inexpensive mechanism 45 for providing the advantages of this invention. One such mechanism 45 is located at the top of each of the columns 25a and 25b in FIG. 1. As these mechanisms, however, are mirror images of each other, FIGS. 3 through 5 depict the mechanism 45 associated with column 25a and post 33a generally viewed from the center of the table.

FIG. 4 most clearly depicts the details of the rack 42a and pinion 43a. The pinion 43a rotates with a shaft assembly 44a that lies along a common shaft axis 50. The rack 42a is recessed in the front channel 40a of the post 33a and the pinion 43a has an appropriate radius whereby the pinion 43a and rack 40a engage. The shaft 44a additionally supports rollers 51 and 52 on opposite sides of the pinion 43a. These rollers engage front surfaces 53 and 54 of the post 33a on either side of the front channel 40a. This establishes a constant compression loading between the gear teeth on the rack 40a and pinion 43a to prevent binding during operation. Bushings 55 and 56 located in a frame 57 support the shaft 44a.

FIG. 4 further depicts a shaft extension 44c that overlies and is fixed to the shaft 44a thereby to complete the shaft assembly 44. The shaft extension 44c, at its other end, connects to a corresponding shaft from the pinion 43b shown in FIG. 2.

The remainder of the mechanism 45 shown in FIGS. 3 through 5 stabilizes the structure to provide a cantilevered work surface that does not deflect under load and additionally is stable in the horizontal plane. This mechanism 45 provides a four-point support between the column 25a and the post 33 to provide this stability. Moreover, the mechanism spaces the post 33a from the column 25a to eliminate any contact except at the four points.

Referring to FIGS. 3 and 5, a roller 60 having the same diameter as the rollers 51 and 52 rides on a shaft 61 disposed vertically under the shaft 44 and mounted to the frame 57. The roller 60 extends along the shaft 61 over a length corresponding to the total length of the rollers 51 and 52 and intermediate pinion 43a. Consequently the roller 61 engages both the end surfaces 53 and 54 of the post 33a. The rollers 51, 52 and 61 therefore define a vertical plane in the orientation shown in FIGS. 3 and 5 for supporting the post 33a.

FIGS. 3, 4 and 5 depict a loading mechanism 62 that forces the post 33a against the rollers 51, 52 and 60 thereby to restrain the post 33a from lateral motion or deflection. The loading mechanism 62 includes a U-shaped member 63 that includes upper and lower slots aligned vertically with the centers of the shaft 44 and shaft 61 respectively. The upper slot 64 supports an upper shaft 65 for rotation with an upper roller 67. The lower slot 65 carries a lower shaft 70 and lower roller 71. Each of the rollers 67 and 71 has a width that corresponds to the width of the rear channel 41*a*. Consequently when the inner edges of the roller 71 are disposed in the channel 41*a*, they engage side wall 72 and 73 of the rear channel 41*a* to prevent lateral displacement.

A U-shaped frame member 75 attached to the main frame 57 captures the U-shaped channel 63. An upper threaded aperture 76 through the frame 75 is aligned with the shaft 66 and receives and adjusting screw 77 that bears against the member 63. Similarly a lower threaded aperture 80 aligned with the shaft 70 receives an adjusting screw 81 that bears against the member 63. As will now be apparent, once the mechanism is assembled, the adjusting screws 77 and 81 establish forces that orient the member 63 and position the rollers 67 and 71 to produce lateral forces against an end wall in the rear channel 41*a*. As these forces are applied by rollers 67 and 71, the post 33*a* is free to move vertically in the column 24*a*. However, the post 33*a* can not move laterally in the column 25*a*. Moreover, this loading by the mechanism 62 does not impact the load between the rack 42 and pinion 43*a* because the rollers 51, 52 and 60 provide a fixed spacing between the rack 42*a* and the pinion 43*a*.

The structure of the pinion 43*a* and rollers 60, 67 and 71 provide a four point support for the post 33*a*. Loading on the cantilevered table tends to produce a counterclockwise moment of the post 33*a* about the pinion 43*a*. However, the roller 71 produces a clockwise offsetting moment so the post 33*a* does not deflect. Stated alternatively, the rollers 51 and 52 and the rollers 60, 67 and 71 constitute one embodiment of first and second pluralities of guides intermediate each pair of the first and second supports that stabilizes the horizontal position of the second support or post 33*a* or 33*b* within the first support or column 25*a* or 25*b* and thereby stabilizes the work table 20 with respect to the base 23.

This stabilizing mechanism is readily adjusted. It introduces minimum friction because the rollers all provide point contact with the post 33*a*. However other approaches can also be used. For example, the adjustment mechanism 62 might be replaced with a solid glide bar of low friction that would ride in the rear channel 41*a*. One might also eliminate the lower roller 60 and shaft 61 thereby to provide three-point support. Any of these alternatives might be satisfactory for certain applications while still providing the stable adjustable work surface that is disclosed in FIGS. 1 through 6.

This invention has been disclosed in terms of certain embodiments. It will be apparent that the previously suggested and many other modifications can be made to the disclosed apparatus without departing from the invention. Therefore, it is the intent of the appended claims to cover all such variations and modifications as come within the true spirit and scope of this invention.

What is claimed as new and desired to be secured by Letters Patent of the United States is:

1. An article of furniture comprising:

a) a base with a pair of hollow, spaced, vertical first supports that each terminate at a free end thereof and that each have a substantially constant cross-section throughout the length thereof, b) a pair of spaced depending second supports that align with and nest in corresponding ones of said first supports, c) a work table cantilevered from said pair of second supports, d) a power drive interconnecting said base and said second supports for adjusting the vertical position of said work table with respect to said base thereby producing relative linear motion between said first and second supports, e) a rack at each of corresponding sides of said second supports, portions of said racks coextensive with nested portions of said second supports being located inside said first supports, f) a pinion mounted inside and supported by each of said first supports proximate the free end thereof for engaging a corresponding one of said racks whereby linear motion of each of said second supports rotates the corresponding pinion in the corresponding first support, each of said pinions lying on a common axis, g) a rigid link supported by said first supports and fixed to each of said pinions for lying along the common axis thereby to prevent said pinions from rotating relative to each other, said rigid link being adapted for rotation with said pinions relative to said first supports, h) first guide means intermediate nested ones of said first and second supports for spacing said corresponding ones of said first and second supports, and i) second guide means intermediate nested ones of said first and second supports for spacing said corresponding ones of said first and second supports, said second guide means being spaced from said first guide means whereby said first and second guide means stabilize the relative positions of said base and said work table.

2. An article of furniture as recited in claim 1 wherein each said second support includes a post with a rear elongated channel formed therein and wherein each of said spaced guide means additionally comprises glides supported by said first supports for engaging said rear channel thereby to maintain the engagement of said rack and pinion during relative motion between said first support and post.

3. An article of furniture as recited in claim 2 characterized by having a front and back portion wherein each of said first and second supports is positioned adjacent the back portion and said drive means interconnects said base and said work table at the back portion thereof intermediate said pairs of first and second supports, each of said glide means including a roller for interacting with said corresponding rear channel to stabilize the horizontal position of said cantilevered work table and adjustment means for positioning each said roller with respect to said first and second supports.

4. An article of furniture as recited in claim 3 wherein said drive means comprises a linear drive means for displacing said work table taken from the group of linear drive means consisting of manually operated, electrically operated and pneumatically operated linear drive means.

* * * * *